US007458870B2

(12) United States Patent
Onishi

(10) Patent No.: US 7,458,870 B2
(45) Date of Patent: Dec. 2, 2008

(54) PRODUCING METHOD FOR SUBSTRATE, PRODUCING APPARATUS FOR SUBSTRATE, PRODUCING METHOD FOR IMAGE DISPLAY APPARATUS AND IMAGE DISPLAY APPARATUS

(75) Inventor: Tomoya Onishi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 640 days.

(21) Appl. No.: 11/166,107

(22) Filed: Jun. 27, 2005

(65) Prior Publication Data

US 2006/0001358 A1 Jan. 5, 2006

(30) Foreign Application Priority Data

Jun. 30, 2004 (JP) ..... 2004-193602
Jun. 9, 2005 (JP) ..... 2005-169454

(51) Int. Cl.

| | |
|---|---|
| ***H01J 1/62*** | (2006.01) |
| ***H01J 63/04*** | (2006.01) |
| ***H01J 9/00*** | (2006.01) |
| ***H01J 9/24*** | (2006.01) |

(52) U.S. Cl. ..... 445/24; 445/25; 313/495

(58) Field of Classification Search ..... 445/24–25
See application file for complete search history.

(56) References Cited

U.S. PATENT DOCUMENTS 6,507,594 B1 * 1/2003 Furukawa et al. ..... 257/734
6,750,854 B1 6/2004 Onishi ..... 345/204
6,840,832 B2 1/2005 Suzuki et al. ..... 445/5
7,034,449 B2 4/2006 Suzuki et al. ..... 313/495

FOREIGN PATENT DOCUMENTS

JP 8-100256 4/1996
JP 2002-83542 3/2002

OTHER PUBLICATIONS

K. Sakai, et al., "Charging and Behavior of a Spherically Conducting Particle on a Dielectrically Coated Electrode in the Presence of Electrical Gradient Force in Atmospheric Air", IEEE Transactions on Dielectrics and Electrical Insulation, vol. 9, No. 4, pp. 577-588 (Aug. 2002).

* cited by examiner

*Primary Examiner*—Sikha Roy
*Assistant Examiner*—Natalie K Walford
(74) *Attorney, Agent, or Firm*—Fitzpatrick, Cella, Harper & Scinto

(57) ABSTRACT

The invention is to provide a flat panel display of excellent characteristics, not easily causing a discharge. For this purpose, the invention provides a producing method for an image display apparatus including a first substrate with an conductive surface, and a second substrate with an conductive surface opposed to the first substrate, the method including: a step of applying a voltage between the first substrate and the second substrate; and a step of introducing conductive particles into a space between the first substrate and the second substrate under the voltage application; wherein the voltage applied between the first substrate and the second substrate causes the introduced conductive particles to reciprocate between the first substrate and the second substrate and to collide with dust attached to the first or second substrate, thereby removing the dust from the first or second substrate.

14 Claims, 12 Drawing Sheets

PRODUCING METHOD FOR SUBSTRATE, PRODUCING APPARATUS FOR SUBSTRATE, PRODUCING METHOD FOR IMAGE DISPLAY APPARATUS AND IMAGE DISPLAY APPARATUS

BACKGROUND OF THE INVENTION

1. Field of the Invention

The present invention relates to a producing method for a substrate for an electronic device having a conductive member on a surface, and a cleaning apparatus. In particular, it relates to a producing method for an image display apparatus having a conductor on a surface and such an image display apparatus, and more particularly to a producing method for an image display apparatus utilizing an electron beam such as a field emission display (FED) and such an image display apparatus.

2. Related Background Art

Non-patent Literature 1 describes a technology in which conductive particles execute a reciprocating motion between electrodes and go out of the electrodes.

Also a method of moving dusts is described in Patent Literatures 1 and 2, utilizing the technology disclosed in Non-patent Literature 1.

Also in image display apparatuses including cathode ray tube (CRT), developments are being made for realizing a larger image size.

Also a thinner structure, a lower weight and a lower cost are becoming important issues with an increase in the image size.

However, a CRT, in which electrons accelerated with a high voltage are deflected by deflecting electrodes for exciting a phosphor on a face plate, basically requires a larger depth in case of a larger image size and is difficult to provide a product of a small thickness and a low weight.

The present inventors have made investigations, as an image display apparatus capable of resolving the aforementioned limitations, on a surface conduction electron emitting device and an image display apparatus utilizing such surface conduction electron emitting device.

The present inventors have tried an application of multi electron beam sources as shown in FIG. 14.

In FIG. 14, there are schematically illustrated surface conduction electron emitting devices 4101, column wirings 4102 and row wirings 4103 which constitute multiple electron beam sources wired in a simple matrix configuration.

FIG. 14 also shows a structure of a cathode ray tube (also represented as image display panel) utilizing such multi electron beam sources, constituted of a substrate 4001 (also represented as rear plate) of an outer envelope provided with electron emitting devices 4101, row wirings 4102 and row wirings 4103, a lateral wall 4003 (also represented as supporting frame or outer envelope frame), and a face plate 4002 provided with a phosphor layer 4201 and a metal back 4203.

A phosphor layer 4201 on the face plate 4002 is provided with a phosphor for emitting light by an excitation with electrons, and a black matrix for suppressing a reflection of an external light and for avoiding color mixing of the phosphors.

The phosphor layer 4201 and the metal back 4203 are given a high voltage through a high voltage terminal 4005 and constitute an anode electrode.

In such image display apparatus, a high voltage (also represented as an accelerating voltage or an anode voltage) is applied to the metal back 4203 constituting a part of the anode electrode, to generate an electric field between the rear plate 4001 and the face plate 4002, thereby accelerating the electrons emitted from the electron beam sources and exciting the phosphor to cause a light emission and an image display.

As the luminance of an image display apparatus is significantly dependent on the accelerating voltage, the accelerating voltage has to be elevated in order to achieve a high luminance.

Also in order to realize a thin image display apparatus, it is necessary to reduce the thickness of the image display panel, and, for this purpose, the distance between the rear plate 4001 and the face plate 4002 has to be made small.

Because of these facts, a considerably high electric field is generated between the rear plate 4001 and the face plate 4002.

Patent Literature 1: Japanese Patent Application Laid-Open No. H08-100256

Patent Literature 2: Japanese Patent Application Laid-Open No. 2002-083542

Non-Patent Literature 1: IEEE Transactions on Dielectrics and Electrical Insulation, vol. 8, No. 4; August 2002.

Patent Literature 1 discloses, for eliminating dusts, a method of eliminating dusts deposited on a deposition preventing plate in a film forming apparatus such as a sputtering apparatus.

In such method, very large dusts, for example those having a size of 100 μm or larger, can easily be liberated from an electrode and can initiate a reciprocating motion because of a large charge amount leading to a large Coulomb force acting on the particles.

However, small dusts or small unnecessary structural fragments (such as burrs) are not easily liberated by the Coulomb force and cannot therefore be removed.

An object of the present invention is to clean such small dusts or small unnecessary structural fragments that are difficult to remove with the Coulomb force only.

Also as an object of cleaning, the substrate of a flat panel display requires a cleaning for following reasons, and the present invention can be advantageously utilized for obtaining a flat panel display of excellent characteristics.

FIG. 15 is a schematic cross-sectional view of the above-described display panel.

The image display apparatus (flat panel display) is provided with a rear plate 4001 having an electron beam source and a face plate 4002 having a metal back 4203 constituting an anode electrode, to which an accelerating voltage Va is applied.

The anode electrode 4203 is insulated from the electron beam source by a vacuum gap between the face plate 4002 and the rear plate 4001.

A dimension of the vacuum gap defines a depth of the image display panel and is therefore preferably made smaller.

However, a smaller depth of the display panel, with a same voltage applied to the anode electrode 4203, results in an increase in the electric field intensity which is defined by dividing such voltage with the distance, thereby increasing a probability of causing a discharge between the anode electrode 4203 and the electron beam source.

Such discharge may significantly deteriorate the image quality of the image display apparatus, thus giving a major difficulty in improving the reliability of the image display apparatus.

Following three causes are conceivable for a discharge in vacuum: (1) an electron emission is caused by a concentration of electric field on a minute projection present on a cathode (rear plate in the present case), and the minute projection is heated by a Joule's heat of a current flowing in the minute projection (cathode heating assumption), thereby inducing a discharge; (2) an opposed anode (face plate in the present case) is heated by electron collision (anode heating assumption), thereby inducing a discharge; (3) clumps or minute dusts sticking to the electrode are liberated and accelerated by an electrostatic force and collide with an electrode to cause a heating of the electrode or the minute dusts, thereby leading to a discharge (clump assumption).

Also in case of increasing the area size of the image display panel, an increase in the area size tends to cause following two situations in the manufacturing process: (4) a defect in the form of a minute projection, directly leading to a discharge, is generated in the display panel; and (5) fragments (dusts) generated by a fragmenting of a conductive substance from a member constituting the display panel contaminate the panel.

Therefore, with an increase in the size of the display panel, influence of the discharge caused by the minute projections and the dusts becomes more important.

Therefore, an object of the present invention is to provide, for application to the aforementioned image display apparatus, a substrate for a flat panel display free from causes of discharge thereby providing a flat panel display of excellent characteristics having a low probability of discharge.

The present invention provides a technology capable, instead of the technology disclosed in Patent Literature 1 in which the conductive particles are charged, liberated and put into a reciprocating motion in a passive manner, of introducing desired particles between the substrates and moving such particles by an electric field thereby forcedly causing dusts sticking to the substrate to initiate a reciprocating motion and also destructing and removing substances of a projecting form.

SUMMARY OF THE INVENTION

For attaining the aforementioned objects, the present invention provides a producing method for an image display apparatus including a first substrate with an conductive surface, and a second substrate with an conductive surface opposed to the first substrate, the method including:

a step of applying a voltage between the first substrate and the second substrate; and a step of introducing conductive particles into a space between the first substrate and the second substrate under the voltage application;

wherein the voltage applied between the first substrate and the second substrate causes the introduced conductive particles to reciprocate between the first substrate and the second substrate and to collide with dust attached to the first or second substrate, thereby removing the dust from the first or second substrate.

The present invention also provides an image display apparatus provided with an envelope including:

a rear plate having an electron beam source; and a face plate having a phosphor which emits a light by an electron beam irradiation and an anode electrode for applying an electron accelerating voltage;

wherein the image display apparatus includes conductive particles in the envelope, a mechanism for maintaining the conductive particles within the envelope but outside a normal projection region from the anode electrode onto the rear plate, a mechanism for moving the conductive particles into the normal projection region from the anode electrode, and a mechanism for causing the conductive particles to execute a reciprocating motion within the normal projection region from the anode electrode.

The present invention also provides a producing method for a substrate having a conductor on a surface thereof, the method including:

a step of placing a conductive member in an opposed relationship, across a space, to the conductor-including surface of the substrate and applying a voltage between the conductor and the conductive member; and a step of introducing conductive particles into the space between the conductor and the conductive member under the voltage application;

wherein the voltage applied between the substrate and the conductive member causes the introduced conductive particles to execute a reciprocating motion between the substrate and the conductive member and to collide with dust attached to the substrate, thereby removing the dust from the substrate.

The present invention also provides a cleaning apparatus including:

means which positions a substrate having a conductor on a surface thereof;

means which places a conductive member in an opposed relationship, across a space, to the conductor-including surface of the substrate;

means which provides the conductor with a first potential and the conductive member with a second potential different from the first potential, thereby generating an electric field between the conductor and the conductive member;

means which introduces conductive particles between the conductor and the conductive member with thus provided potentials; and means which causes the introduced conductive particles to execute a reciprocating motion between the substrate and the conductive member.

DETAILED DESCRIPTION OF THE PREFERRED EMBODIMENTS

Figure 1:
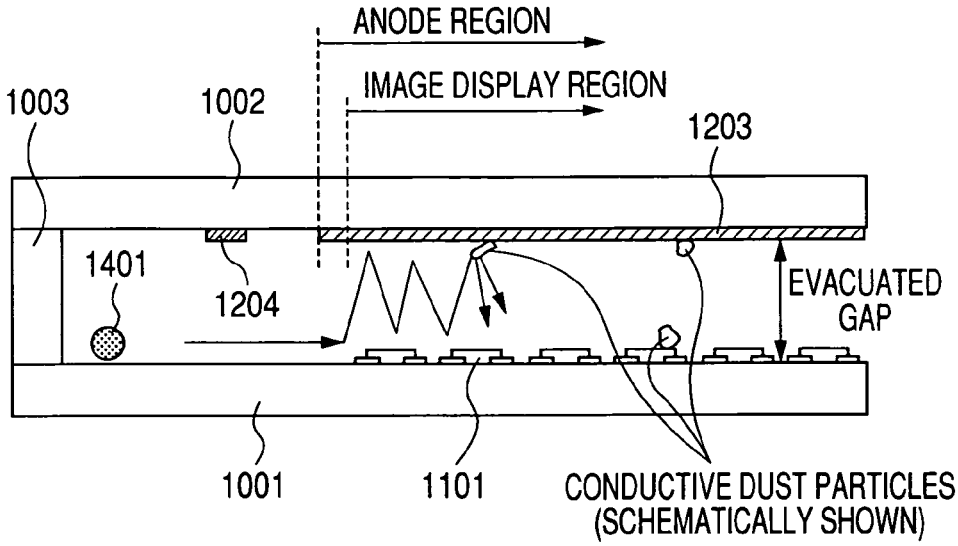
FIG. 1 is a schematic cross-sectional view showing an image display apparatus in an embodiment of the present invention.

In the following, the present invention will be clarified by preferred embodiments thereof, with reference to the accompanying drawings.

At first, an embodiment of the present invention will be explained briefly.

A cleaning method in an embodiment of the present invention is to eliminate dusts attached to a substrate having a conductive member and to eliminate unnecessary projecting substances, and a substrate to be cleaned is not limited to a flat substrate but includes also a curved substrate or a component thereof.

In particular, it is advantageously applicable to a cleaning of a substrate of a flat panel display.

Among the flat panel displays, a display utilizing an electron acceleration by applying a high voltage on a vacuum gap such as an FED (field emission display) or a display utilizing surface conduction electron emitting devices, minute dusts or minute projections cause drawbacks and the cleaning method of the present embodiment can significantly improve the characteristics.

Also in such display utilizing a high voltage application to a gap, there can be provided a mechanism of executing the cleaning method of the present embodiment thereby cleaning the interior of the display panel at an arbitrary timing.

Such cleaning mechanism provided in the display panel itself allows to obtain a display panel of a high reliability.

In the following there will be explained a reason that the cleaning method of the present embodiment is required in a display utilizing a high voltage application to a gap, and a principle of substrate cleaning by a reciprocating motion of conductive particles (controllable particles) and dusts (hereinafter, conductive particles and dusts being collectively called conductive minute substances) employed in the present embodiment.

In an image display apparatus in which the interior of a panel is evacuated to a vacuum state and is subjected to a high voltage application, dusts present therein induce a discharge.

The discharge by such dusts is presumably caused by a phenomenon that the dusts are charged by the electric field in the image display panel and are subjected to a Coulomb force, thereby being accelerated to acquire a kinetic energy and colliding with an opposed substrate whereby an electrode or the dusts are heated to induce a discharge.

In case the conductive minute substance has a particle size (radius) r and a gap between parallel flat electrodes has a voltage V and an electric field E (E=V/d wherein d being gap), a charge amount q (absolute) of the conductive minute substance is given by an equation 1:

$$q = \frac{2}{3}\pi^3 \varepsilon E r^2 \tag{1}$$

wherein ϵ indicates a dielectric constant of a medium (vacuum in this case).

The induced charge amount is negative or positive respectively in case the conductive minute substance is attached to a cathode or an anode.

The conductive minute substance, upon being charged, receives an energy from the electric field and starts to fly toward the opposed substrate.

Upon colliding with the electrode of the opposed substrate, the conductive minute substance bounces back and is charged in an opposite polarity (charge exchange) at the same time, thereby flying again toward the opposed electrode.

Based on the foregoing, in order that a discharge can be induced by the conductive minute substances (principally dusts), following conditions have to be satisfied:

(1) Conductive minute substance is liberated from the electrode and starts to fly:

(2) Conductive minute substance receives an energy at least equal to a certain level from the electric field. An increase in the energy is caused by parameters:

(a) a large particle size (r);

(b) a large voltage (V); and (c) a large electric field intensity (E=V/d)

Therefore, a discharge is not induced in case the conductive minute substance does not fly, or in case the energy received by the conductive minute substance from the electric field even if the conductive minute substance flies and executes a reciprocating motion.

Among the latter parameters, the particle size of the dusts within the conductive minute substances is an uncontrollable parameter while the gap d is fixed, so that the discharge is not induced when the voltage V is small.

The conductive minute substances, in a reciprocating motions under a voltage not inducing a discharge, move in random manner within a region under an electric field application, but discontinue such reciprocating motions upon reaching a region without such electric field.

As a result, the conductive minute substances become localized in a region without the electric field (such effect being called a move out (remove) effect for the conductive minute substances).

Therefore, by initiating the motion of the conductive minute substances under a voltage application not inducing a discharge, the conductive minute substances move to a region without the electric field thereby reducing the possibility of discharge.

However, the dusts stick to the electrode surface by an adhesive force such as a van der Waals' force or a mirror force.

Therefore, when a voltage not inducing a discharge is applied in order to collect the dusts in a region without the electric field, a force for liberating the dusts from the substrate is relatively weak in case the electric field intensity (namely Coulomb force) is low and the dusts cannot start the reciprocating motion.

A large voltage V has to be employed for increasing the Coulomb force, but an excessive increase in the voltage V increases a danger of causing a discharge when the dusts start to move by the Coulomb force.

It is however possible to include conductive particles of desired material, shape and size (such particles being called controllable particles 1401 in a sense that they are controllable from the exterior) in a vacuum vessel as shown in FIG. 1, and to cause the controllable particles 1401 between the electrodes by a phenomenon of a reciprocating motion of a conductive particle between electrodes under an electric filed application thereby causing the controllable particles 1401 to collide with the adhering dusts to be moved and providing a physical impact capable of overcoming the adhering force, whereby the dusts can initiate the motion (such process being called a cleaning by the controllable particles 1401).

For the controllable particles 1401 and the image display apparatus of the invention, there are required:

(1) a mechanism capable of intentionally moving the controllable particles 1401 to a region under an electric field when a cleaning operation by the controllable particles is started;

(2) a mechanical capable of intentionally moving the controllable particles 1401 to a region without an electric field and maintaining the controllable particles 1401 outside the electric field, in order not to constitute a cause for a discharge; and (3) a mechanical capable of causing a reciprocating motion of the controllable particles 1401.

As means which intentionally moving the controllable particles 1401, a gravitational force can satisfactorily control the controllable particles 1401, since the gravitational force becomes governing than the adhesive force in case of particles having a certain particle size or larger.

It is also possible to intentionally move the controllable particles 1401 by a magnetic force, by employing conductive magnetic particles as the controllable particles 1401.

In either case, a mechanism for holding the controllable particles 1401 in the image display apparatus can be prepared easily.

Also the controllable particles 1401, having an excessively small particle size, stick to the substrate in an uncontrollable state by an adhesive force. In such case it becomes impossible to move the particles to the outside of the electric field by an external force.

In case of spherical particles, a gravitational force or a magnetic force becomes more governing than the adhesive force when the diameter is about 100 μm or larger, though such situation is dependent to a certain extent on a surface state of the substrate and the particle.

For this reason, the controllable particles 1401 preferably have a diameter of 100 μm or larger.

Also the controllable particles 1401, if colliding with an electron emitting device, may deteriorate the characteristics of the electron emitting device.

In certain configurations of the image display apparatus, electric wirings may be provided for power supply to the electron emitting device.

Also an electrode may be provided for controlling a trajectory of electrons emitted from the electron emitting device.

In such cases, there is preferably adopted a configuration in which the controllable particles. 1401 do not collide with the electron emitting device which is relatively easily damaged.

Figure 2:
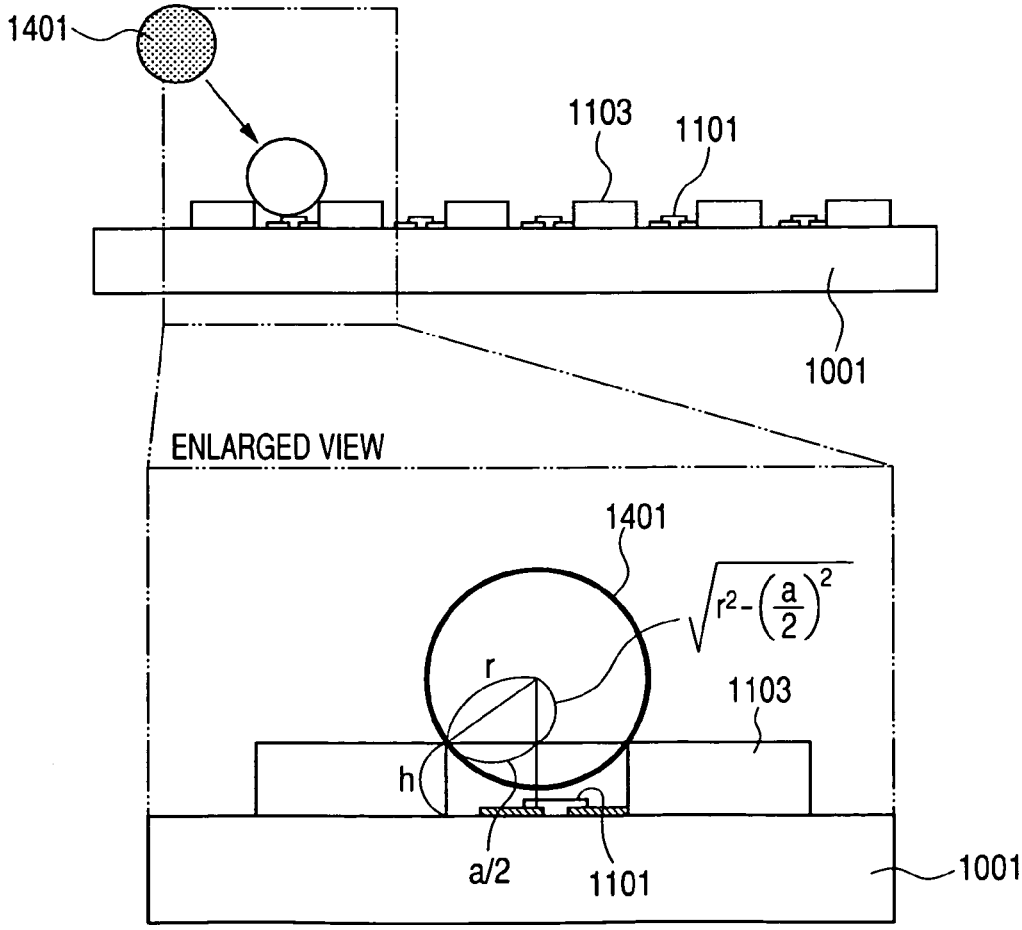
FIG. 2 is a schematic cross-sectional view showing a rear plate and conductive particles (controllable particles) in the image display apparatus in an embodiment of the invention.

More specifically, in case structures such as wirings or electrodes are present in a stripe shape or a matrix shape as shown in FIG. 2, a radius r of the controllable particle 1401, an aperture width a of the structure and a height h of the structure are so selected, in order that the controllable particle 1401 cannot collide with the electron emitting device present between such structures, as to satisfy a relation:

$$r - \sqrt{r^2 - \left(\frac{a}{2}\right)^2} < h \tag{2}$$

Thus, even when the controllable particle 1401 enters at the center of the aperture between the structures, it collides with the structures before reaching the electron emitting device or the like present on the substrate, whereby the electron emitting device or the like can be protected.

Also a minute projection present on the substrate at the cathode side causes an electron emission by a concentration of an electric field at the tip of the minute projection, thereby causing a heating of the cathode or the anode and leading to a discharge.

It is naturally desirable to prevent or to eliminate such minute projection in the course of the manufacturing process, but such prevention or elimination may be impossible because a sealed container is finally formed as a vacuum container.

Even in case a minute projection is present on the substrate at the cathode side in vacuum, the present invention allows to eliminate or deform such minute projection thereby eliminating a projecting shape, by a collision of the controllable particles 1401.

Now an embodiment of the present invention will be explained with reference to FIG. 1, in an example of a display utilizing surface conduction electron emitting devices.

In a display panel having a vacuum container constituted of a rear plate 1001, a place plate 1002 and a lateral wall 1003 to be explained later, the rear plate 1001 is provided with a conductive wiring member such as of Ag, for applying a voltage to a surface conduction electron emitting device 1101.

An opposed conductive member is constituted of an anode electrode 1203 of the face plate 1002, and a gap between the rear plate 1001 and the face plate 1002 is selected as several millimeters.

The wiring member of the rear plate 1001 is set at an approximate ground potential, while a high voltage of several kilovolts is applied to the anode electrode 1203, thereby forming an electric field in the space between the wiring member and the conductive member.

Also conductive particles (controllable particles) are contained in advance in the interior of the display panel constituting a vacuum container, and are rendered movable to a region in which the electric field is applied.

A movement of the particles into the electric field can be achieved by a method utilizing an electric field, a gravitational force or a magnetic force, which can be selected according to the property of the conductive particles (controllable particles) to be contained in the interior.

The conductive particles (controllable particles) preferably have a certain size, in order to be advantageously controlled by an external force such as an electric field, a gravitational force or a magnetic force, and a particle size of 100 μm or larger facilitates such control.

The conductive particles (controllable particles), requiring electroconductivity, is preferably constituted of a metal member, or an oxide having an electroconductivity, or a dielectric material such as glass provided thereon with a conductive film such as of a metal or an oxide.

In particular, a metal material can be advantageously employed as it can be easily prepared into particles of a desired size and can be easily recycled, and for example Cu, Ni or Ag can be employed for this purpose.

The aforementioned reciprocating motion of the conductive particles (controllable particles) under the electric field between the rear plate 1001 and the face plate 1002 allows to eliminate the dusts and the minute projections on the rear plate. For achieving a sufficient cleaning, it is required that the conductive minute substances in the reciprocating motion (controllable particles and dusts that have started the reciprocating motion by the controllable particles) uniformly collide with the entire surface of the substrate.

Therefore, there are preferred conditions in an amount of the controllable particles to be employed and a process time.

More specifically, a number of reciprocating motions of a controllable particle in a unit time is determined by a material of the controllable particle, a distance between the rear plate 1001 and the face plate 1002, and an applied voltage, and the process state of the substrate is principally governed by (number of reciprocating motions per unit time)×(number of particles per unit area)×(process time).

In the configuration of the present embodiment, an advantageous cleaning can be achieved by a process of about 1 minute, in case of scattering controllable particles in an amount of about 1 particle per 1 mm and employing a process voltage of several kilovolts.

Figure 9:
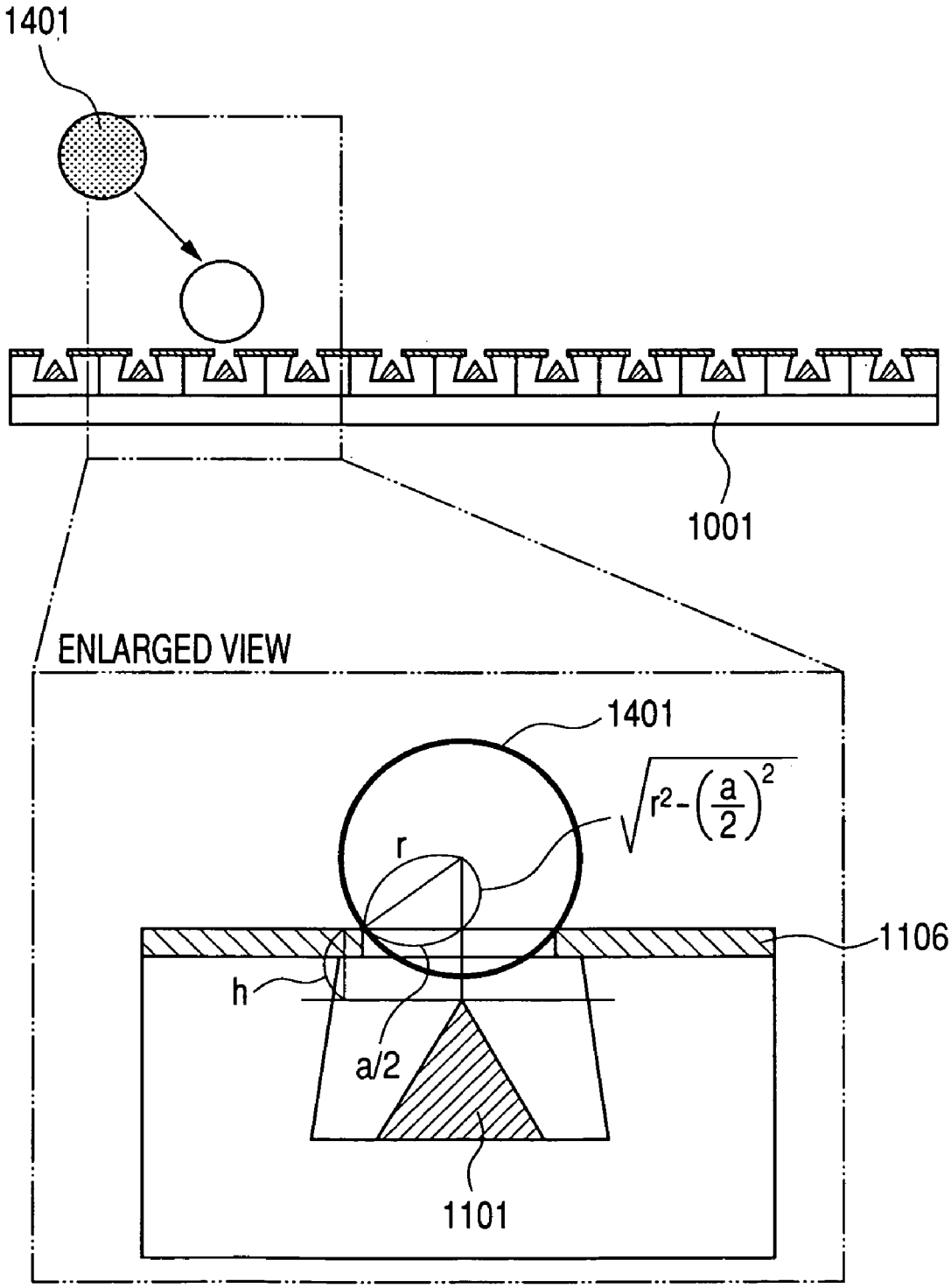
FIG. 9 is a schematic cross-sectional view showing a rear plate and conductive particles (controllable particles) in an embodiment 4 of the invention.

In the following there will be explained an image display apparatus provided with cleaning means of the present embodiment, with reference to FIG. 9 which is a partial magnified view of the image display apparatus and taking an example of an field emission display.

In a display panel maintained in vacuum by a rear plate 1001, a lateral wall (not shown) and a face plate (not shown), controllable particles 1401 are present in the vacuum container.

A gravitational force is utilized for maintaining the controllable particles 1401 and for moving the particles into an anode region, and conductive particles (controllable particles 1401) are employed for causing a reciprocating motion in the anode region.

A method of moving the controllable particles 1401 into the anode region is same as described above.

The rear plate 1001 employed in the present embodiment is provided with spindt type electron emitting devices, and an electron emission is induced by an amplification of an electric field intensity at the tip of the spindt, by a gate electrode 1106.

In the present embodiment, in case the gate electrode has an aperture size of 3 μm and the height h from the tip of the electron emitting device to an upper end of the gate electrode is 0.1 μm, the controllable particle 1401 does not contact the electron beam source 1101 in case it has a size meeting the aforementioned relation 2, whereby the electron beam source can be protected from the damage caused by the collision of the controllable particles.

In the present embodiment, in consideration of the foregoing factors, the radius of the particle is preferably 50 μm or larger (diameter of 100 μm or larger).

In such image display apparatus, the controllable particles 1401 reaching the normal projection region of the anode electrode execute reciprocating motions, thereby initiating a motion of dusts or changing the shape of the minute projections to eliminate factors for discharge in the normal projection region of the anode electrode.

In the following there will be explained an image display apparatus provided with cleaning means of the present invention, with reference to FIGS. 10A and 10B, taking an example of a display utilizing surface conduction electron emitting devices (SED).

A surface treatment method for a substrate having wirings and electron emitting devices will be explained with reference to FIGS. 10A and 10B.

Figure 10A:
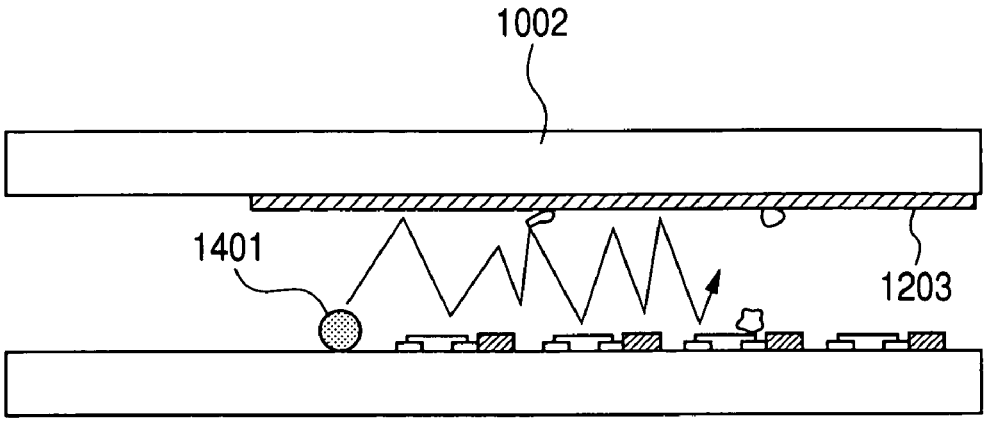
FIGS. 10A and 10B are cross-sectional views having wirings and electron beam sources.
Figure 10B:
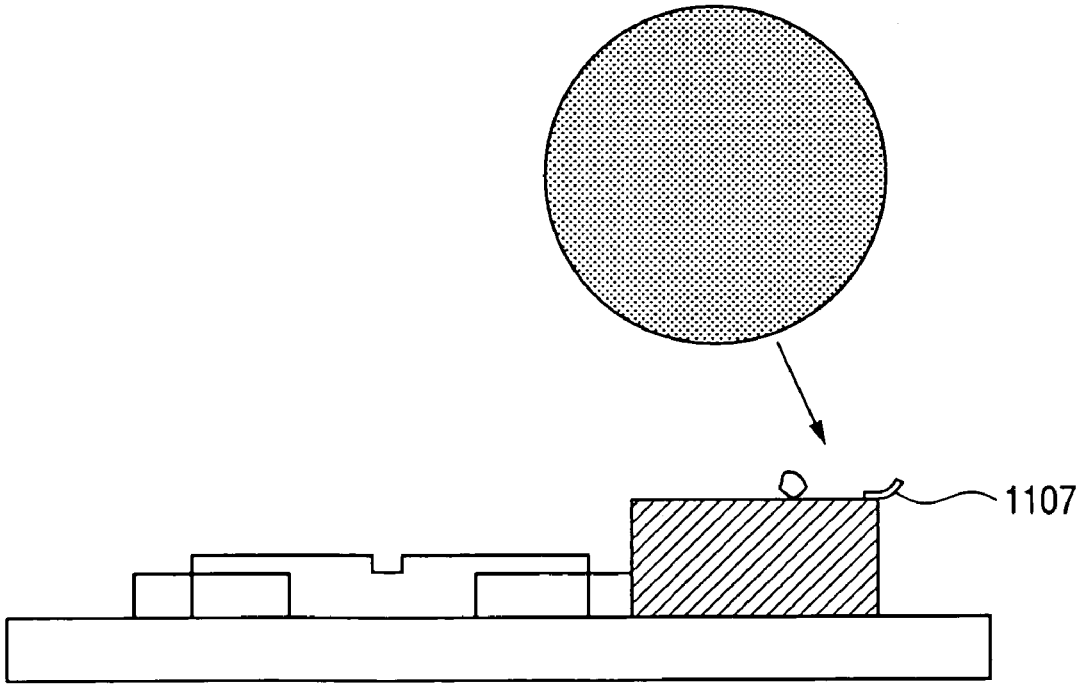

FIGS. 10A and 10B are cross-sectional views of a substrate having wirings and electron emitting devices, wherein a minute projection 1107 is present on the wiring.

In the presence of the minute projection 1107 in an image display apparatus with a high electric field to an opposed substrate, an electric field is concentrated on the minute projection to induce a discharge.

For deforming such minute projection into a smooth shape by a collision of conductive minute substances (controllable particles and dusts), there is utilized the aforementioned phenomenon of a reciprocating motion of the conductive minute substances between the electrodes under the electric field.

Conditions required for the controllable particles include a hardness higher than that of the wiring material constituting the minute-projection to be deformed, an electroconductivity and an ease of elimination of the controllable particles after the process (for example a particle size exceeding a certain level).

The wiring material on the substrate is formed for example by Au, Ag or Cu because of a low volume resistivity.

Therefore, the conductive particles (controllable particles) are required to have a hardness comparable to or higher than that of such electrode material.

For this reason, Ni or Cu can be employed advantageously.

Also the opposed substrate provided for applying an electric field is advantageously formed by a material harder than the conductive particles, in order to avoid abrasion in the electrode portion, and a stainless steel (SUS) or the like is employed advantageously in consideration of ease of handling and availability.

In the following a cleaning method for a substrate having wirings will be explained with reference to FIGS. 11A to 11C.

Also a surface treatment method for a substrate having wirings will be explained with reference to FIGS. 11A to 11C.

Figure 11A:
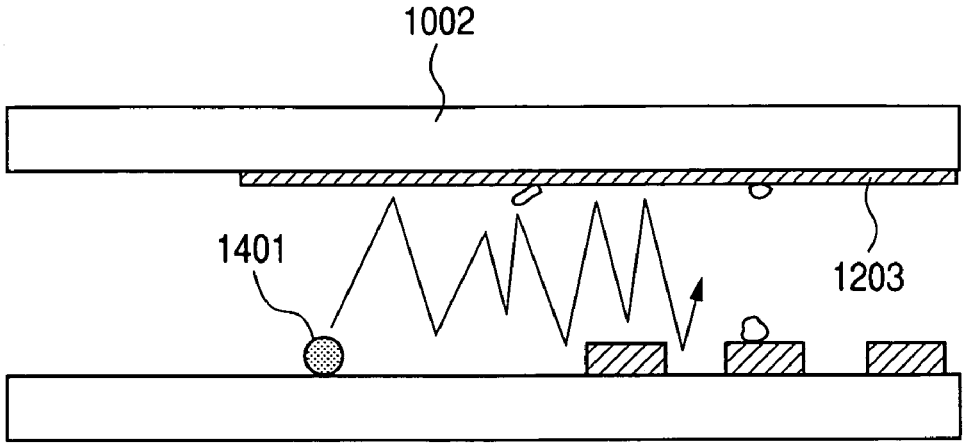
FIGS. 11A, 11B and 11C are cross-sectional views having wiring materials.
Figure 11B:
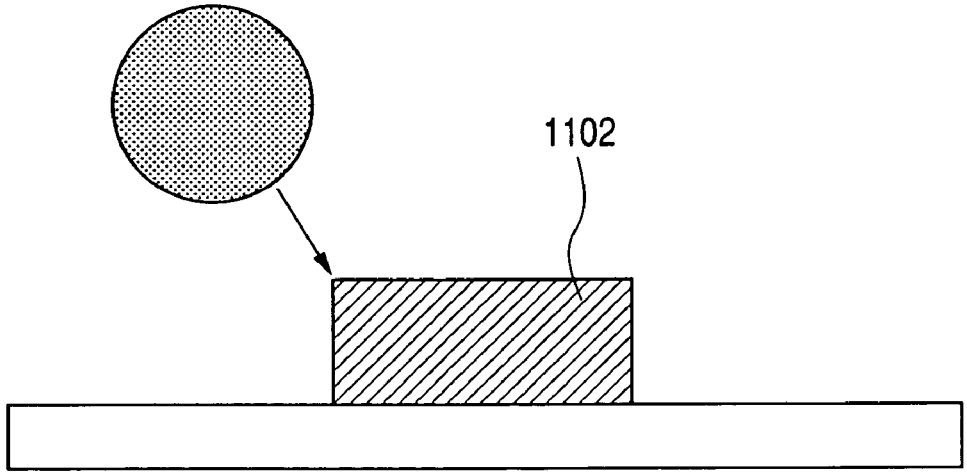
Figure 11C:
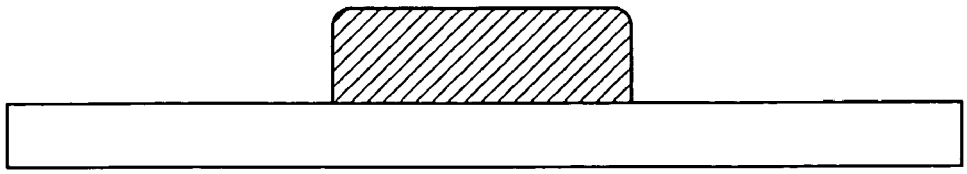

FIGS. 11A to 11C are cross-sectional views of a substrate having a wiring material, in which a wiring is formed by a wiring material containing Ag and a low melting point glass and has a cross-sectional shape including a portion of a small radius of curvature.

Such portion having a small radius of curvature tends to cause a concentration of the electric field, and, depending on the shape thereof, may cause an electron emission under an electric field thereby leading to a discharge.

The aforementioned phenomenon of a reciprocating motion of the conductive minute substances between the electrodes under the electric field is utilized for a surface treatment of causing the conductive minute substances such as the controllable particles and the dusts to collide with the aforementioned portion having a small radius of curvature, thereby deforming such portion of a small radius of curvature and increasing the effective radius of curvature.

Conditions required for the controllable particles, which trigger the reciprocating motion of the conductive minute substances, include a hardness higher than that of the minute projections and the wiring material to be deformed, an ease of elimination of the controllable particles after the process (for example a particle size exceeding a certain level).

Also the opposed substrate provided for applying an electric field is advantageously formed by a material harder than the conductive particles (controllable particles), in order to avoid abrasion in the electrode portion.

In the following a cleaning method of the present invention will be explained with reference to FIG. 12, in a method of cleaning only an arbitrary portion of the substrate.

Also a surface treatment method for a substrate having a conductive surface will be explained with reference to FIG. 12.

Figure 12:
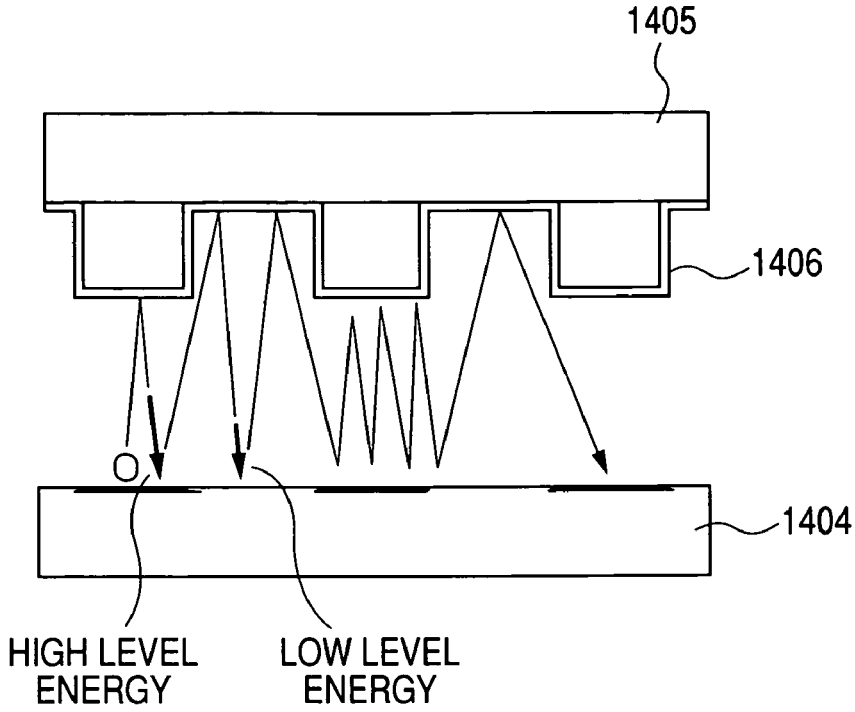
FIG. 12 is a cross-sectional view showing a method for executing a surface treatment for a conductive substrate 1404 only in an arbitrary position.

FIG. 12 is a cross-sectional view showing a surface treatment method in an arbitrary portion of a substrate 1404 having a conductive surface.

For modifying a surface state of a substrate only in an arbitrary portion, conductive minute substances may be made to collide with a portion to be modified, thereby changing a level of convex and concave portions on the surface and achieving a physical etching in certain cases.

For causing a collision of the conductive minute substances, there is utilized the aforementioned phenomenon of a reciprocating motion of the conductive minute substances between the electrodes under the electric field.

An opposed electrode is preferably formed with a mold in such a shape as to have a partially smaller distance to the substrate to be cleaned.

The mold is prepared with a method same as that for a metal mold, and is preferably provided with a hard chromium plating Also the opposed substrate may be formed by a glass which is shaped in a similar form and is provided with an electrode formed thereon.

In a portion with a smaller gap, the particles have a larger charge amount because of an increased electric field intensity (cf. equation (1)).

Therefore, an energy (=Q×V) of the conductive minute substances is larger in the reciprocating motion in a small gap and smaller in the reciprocating motion in a small gap.

Based on this fact, an intensity of the surface treatment (cleaning) of the substrate 1404 can be varied selectively.

Figure 13A:
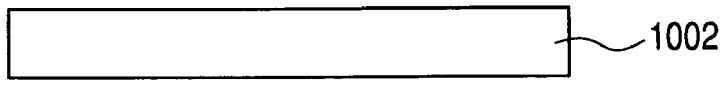
FIGS. 13A, 13B and 13C are cross-sectional views showing a surfaced treatment method for a semiconductor substrate 1407.
Figure 13B:
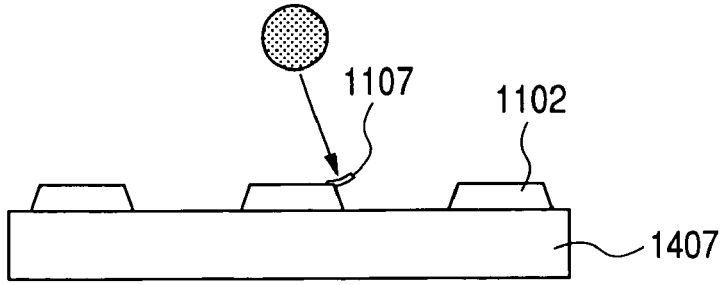
Figure 13C:
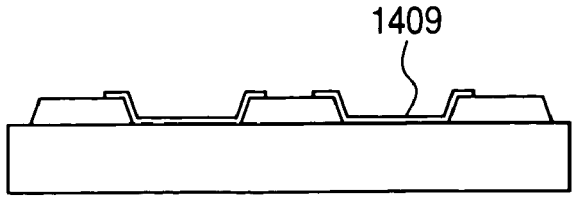
Figure 14:
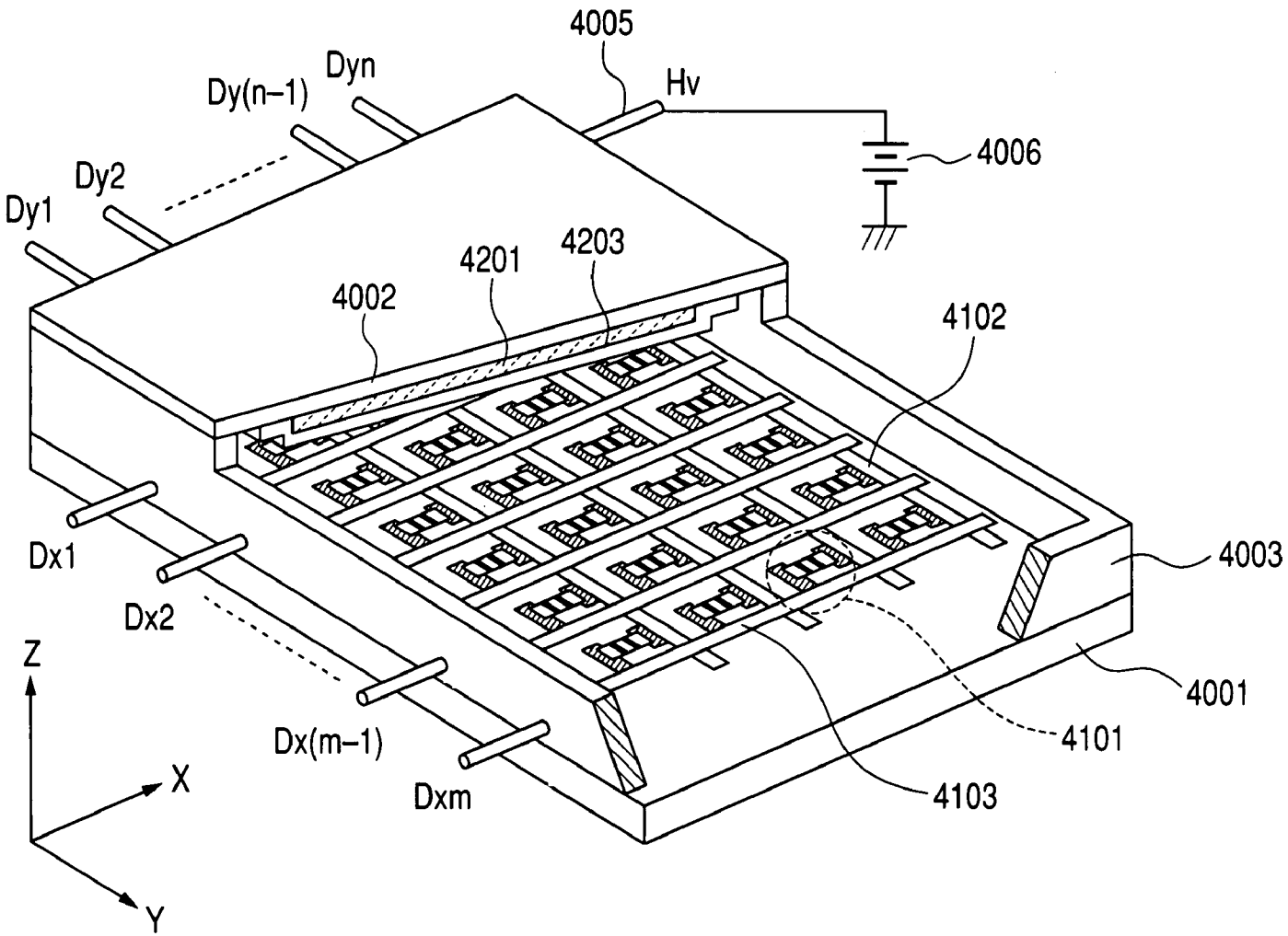
FIG. 14 is a perspective view showing a prior display panel.
Figure 15:
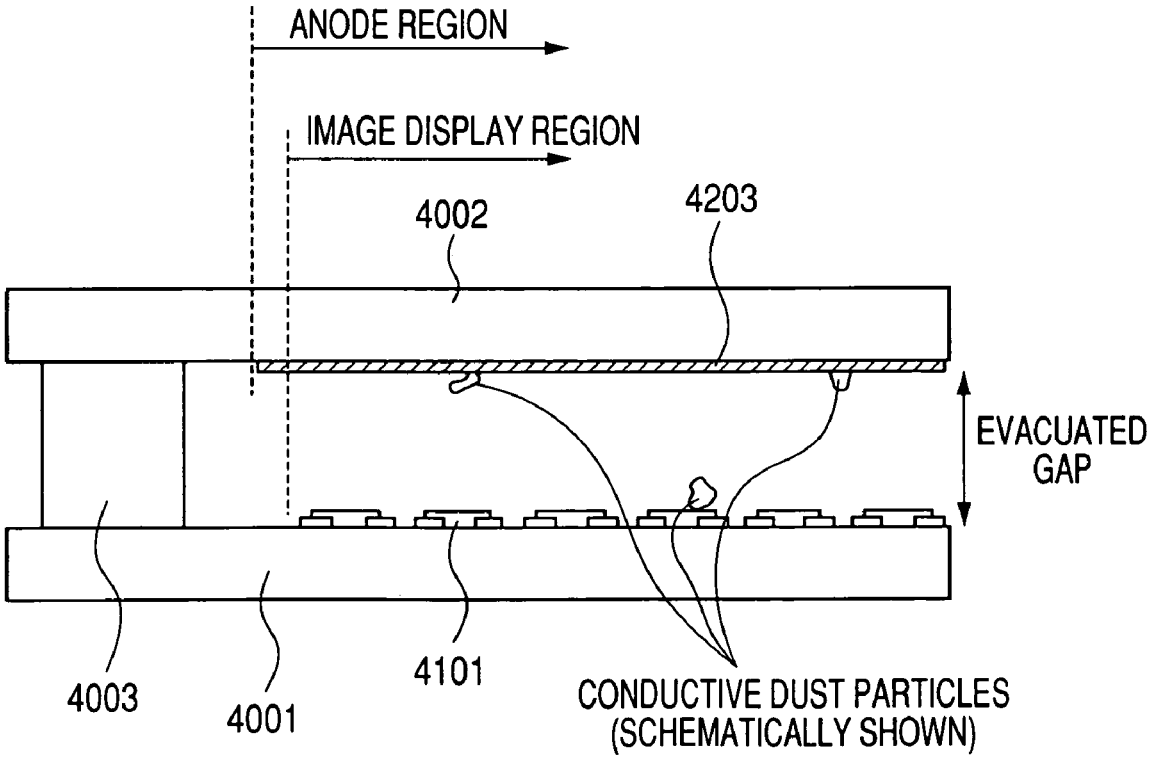
FIG. 15 is a schematic cross-sectional view of a prior display panel.

The present invention is applicable also to a semiconductor substrate. In the following there will be explained a surface treatment method for a semiconductor substrate with reference to FIGS. 13A to 13C.

In case a convex structure 1102 is present on a semiconductor substrate 1407, there may remain a burr-shaped process residue 1107 which is generated with a certain probability in a preparation process of the convex structure.

In the presence of such burr, a uniform continuous film cannot be obtained in a subsequent preparation of a layer 1409 such as an aluminum wiring.

Such burr-shaped defect 1107 can be eliminated by a collision of the conductive minute substances with such burr-shaped defect 1107.

For causing the collision of the conductive minute substances, there is utilized the aforementioned phenomenon of a reciprocating motion of the conductive minute substances between the electrodes under the electric field.

By supplying the semiconductor substrate with a ground potential from a rear surface thereof and the opposed substrate with a high voltage, the conductive minute substances can be charged and put into a reciprocating motion.

Even in case the object of surface treatment is a semiconductor substrate, the conductive minute substances can be charged to a certain extent in an electric field and can be reciprocated.

The conductive particles (controllable particles) employed in the foregoing embodiments are required to have an electroconductivity and a certain hardness, and are formed by particles of following materials (parenthesized number indicating a Morse hardness):

Cu (3.0), Ni (3.5), Ti (4.0), Fe (4.5), W (6.5-7.5) and Cr (9.0).

Also the surface treated objects had a following Morse hardness:

Al (2.7), Al (2.9) and Si (7.0).

The metal plate to be employed can have a Morse hardness lower than that of the conductive particles (controllable particles).

EXAMPLES

In the following, preferred example of the present invention will be explained with reference to the accompanying drawings.

However, in the examples, a dimension, a material, a shape and a relative position of any constituent component are not to be construed to restrict the scope of the invention to such description unless specified otherwise.

Example 1

In the following, an example 1 of the invention will be explained with reference to FIGS. 1, 3, 6A, 6B and 7.

Figure 3:
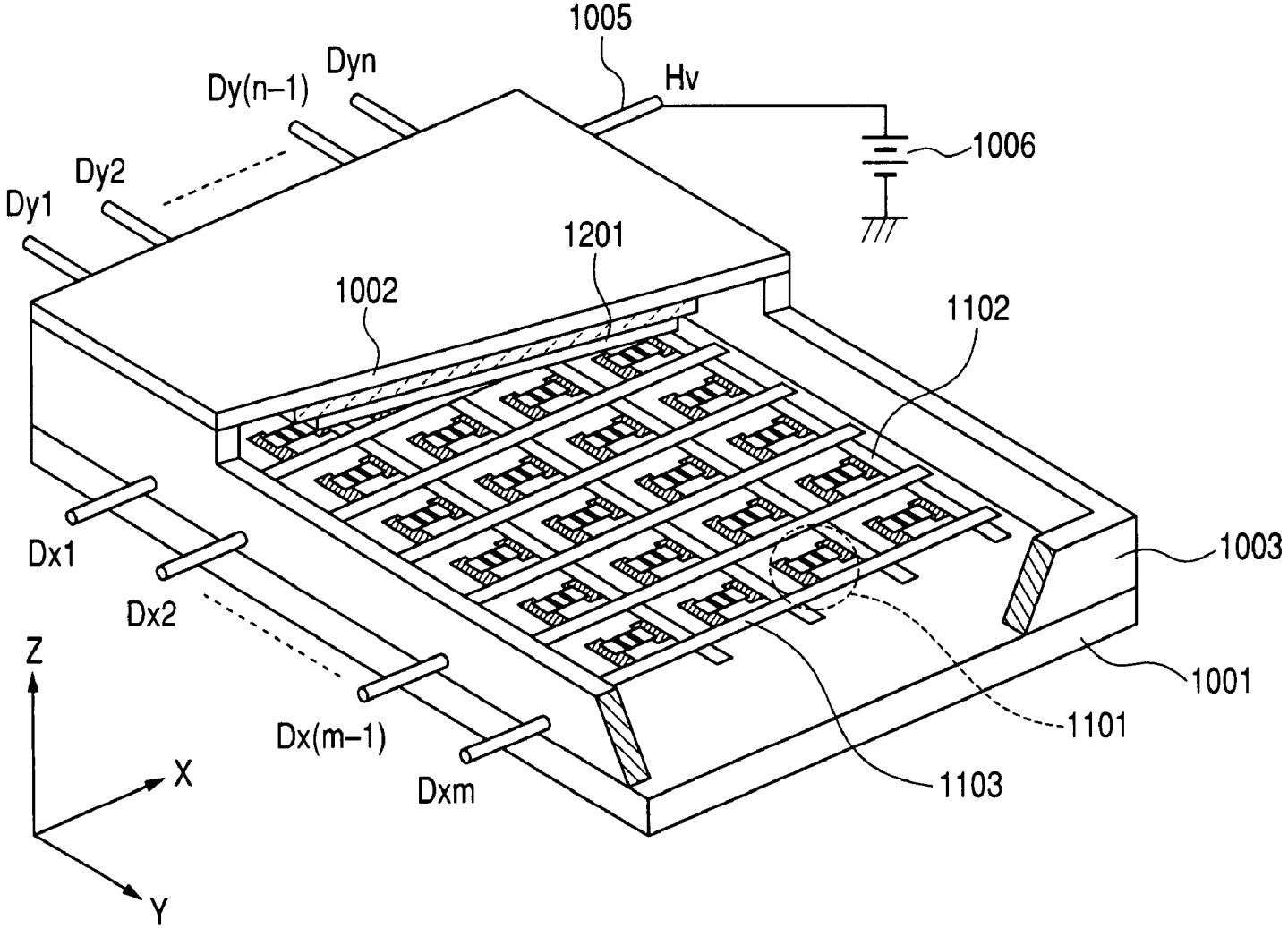
FIG. 3 is a partially cut-off schematic perspective view of an image display apparatus in an embodiment of the invention.

FIG. 3 is a perspective view of a display panel employed in the example, partially cut off in order to show an internal structure.

In FIG. 3, there are shown a bottom 1001 of a external envelope (also represented as a rear plate), a lateral wall 1003 and a face plate 1002, which constitute an air-tight container for maintaining the interior of the display panel in a vacuum state.

The rear plate 1001 and the face plate 1002 was maintained at a gap of 2 mm.

On the rear plate 1001, surface conduction electron emitting devices 1101 are formed by a number of M×N (M and N each being an integer of 2 or larger and suitably selected according to a desired number of pixels; N=240 and M=80 in the present example).

The N×M surface conduction electron emitting devices 1101 are wired in a simple matrix by M row wirings 1103 and N column wirings 1102.

A portion constituted by 1101-1103 will be called multi electron beam sources.

Also the face plate 1002 is provided with a phosphor film 1201 and a metal back 1203 (not shown in FIG. 3) constituting an anode electrode including the phosphor film 1201, and is given an anode potential through a high voltage terminal portion 1005.

In the high voltage terminal portion, an unillustrated high voltage terminal is provided in the face plate and is connected to a high voltage source 1006.

FIG. 1 is a cross-sectional view of an image display apparatus of the present example, also illustrating conductive particles (controllable particles) 1401.

The conductive particles (controllable particles) 1401 are normally positioned outside a normal projection region of the anode electrode 1203 (also simply called an anode region), and also outside a guard ring electrode 1204 positioned at a substantially ground potential, thus receiving an almost zero electric field intensity.

Consequently, the controllable particles 1401 only receive an adhesive force, a frictional force and a gravitational force.

In case of cleaning the dusts and the minute projections in the anode region of the image display apparatus, the image display apparatus is inclined by an angle θ from a horizontal direction as shown in FIG. 6, displacing the controllable particles 1401 into the normal projection region of the anode electrode by the gravitational force.

Then a voltage Vc that can cause a reciprocating motion of the controllable particles 1401 but does not cause a discharge is applied between the anode and the electron beam source.

Thus the controllable particles 1401 reaching the normal projection region of the anode electrode cause, under a reciprocating motion, the dusts to initiate a reciprocating motion. Also the conductive minute substances (controllable particles and dusts) collide with the minute projections, thereby eliminating the causes of discharge in the normal projection region of the anode electrode.

Figure 7:
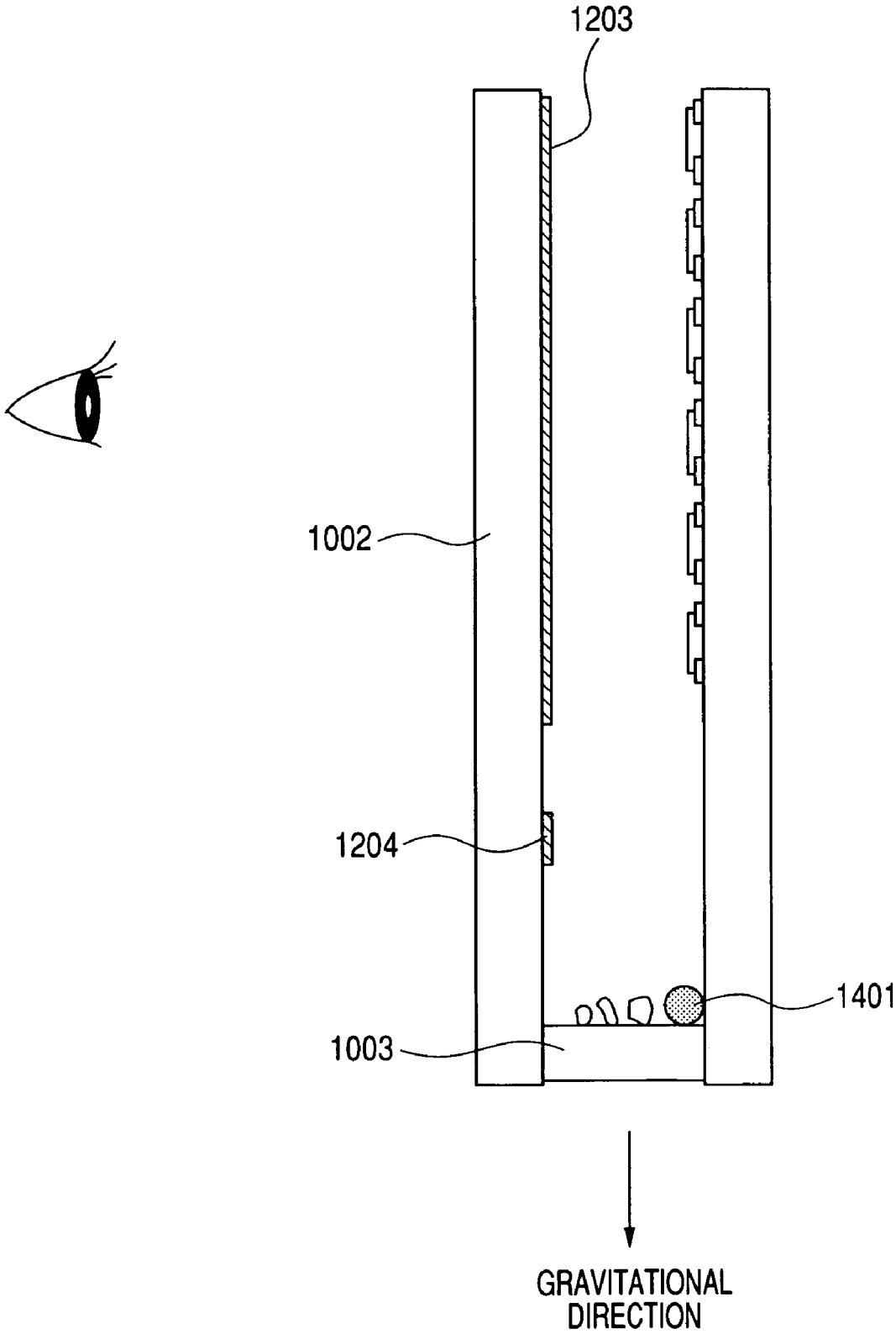
FIG. 7 is a schematic cross-sectional view showing a state of use of an image display apparatus in an embodiment 1 of the invention.

After the movement of the dusts and the elimination of the minute projections are executed sufficiently in this manner, the image display apparatus is returned to the vertical state in the gravitational direction as shown in FIG. 7, whereby the controllable particles 1401 are retained outside the normal projection region of the anode electrode and do not constitute a cause for discharge when a high voltage Va for image display is applied to the anode electrode. Also the discharge is not easily induced since the dusts and the minute projections are eliminated from the normal projection region of the anode electrode.

The controllable particles 1401 employed in the present example may have a particle size that provides a gravitational force larger than an adhesive force acting on the controllable particles and that is variable depending on the state of the face plate and the rear plate, but had a size of 100 μm because a diameter of 100 μm allowed satisfactory movement of the particles by the gravitational force.

Also the controllable particles 1401 had a spherical shape in order to reduce a frictional force at the displacement by the gravitational force, but any shape may be employed as long as the gravitational force becomes governing with respect to the adhesive force and the frictional force.

Also the controllable particles 1401 may be formed by any conductive material as the conductivity is required for causing a reciprocating motion by an electric field, but a metal material is preferable in consideration of ease of preparation, and the present example employed copper particles as the controllable particles 1401.

The effect of the invention can be obtained in case at least a controllable particle 1401 is present in the vacuum panel of the image display apparatus, but plural controllable particles 1401 are preferably provided in order to uniformly clean the normal projection region of the anode electrode.

The image display apparatus employed an anode voltage Va of 10 kV, and an applied voltage at the cleaning by the controllable particles 1401 was selected at 3 kV.

For retaining the controllable particles 1401 outside the anode region, the present example utilized a gravitational force, but a mechanism of more positively holding the controllable particles 1401 after the cleaning may be provided in consideration of a vibration at the transportation or other influences.

Figure 8A:
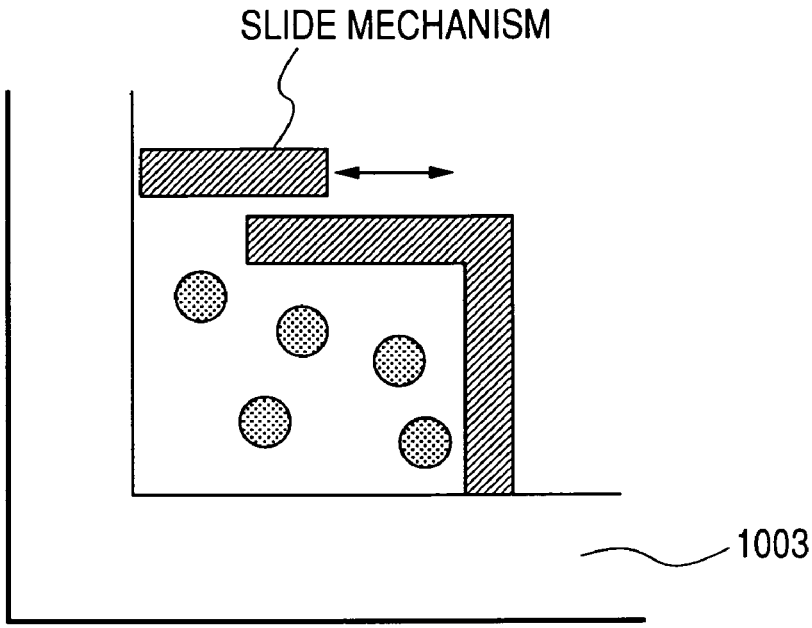
FIGS. 8A and 8B are schematic plan views showing examples of a structure for holding conductive particles (controllable particles) in an embodiment of the invention.
Figure 8B:
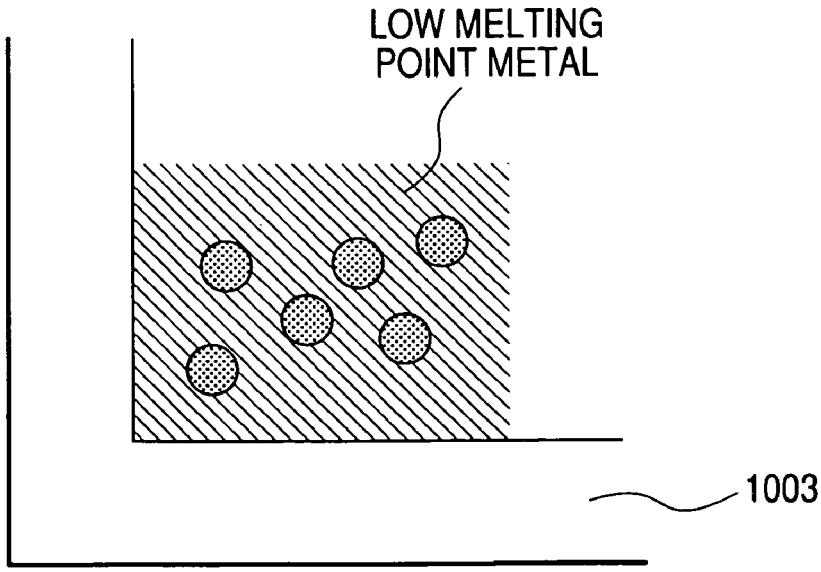

For example there may be adopted a configuration, as shown in FIG. 8A, having an enclosure for the particles and a sliding shutter for enclosing the controllable particles in such enclosure. Also as shown in FIG. 8B, the particles may be adhered to a particle-adhering area (formed by a low-melting metal such as In, which holds the controllable particles 1401 by heating after the controllable particles are moved to such area).

In case of moving the conductive particles (controllable particles) 1401 into the anode region from the exterior by inclining the image display apparatus, such operation can be executed only in a limited timing and cannot be executed while the image display apparatus is in use.

Preferably the operation is executed after the formation of the vacuum container and before an initial application of the high voltage Va (=10 kV) to the anode electrode thereby minimizing the unnecessary discharge.

The image display apparatus thus obtained, when subjected to an application of a high voltage of 10 kV, could display a stable image without any discharged over a prolonged period.

In the following, there will be explained multi electron beam sources employed in the display panel.

The multi electron beam sources to be employed in the image display apparatus of the invention can be any electron sources formed by cold cathode elements in a simple matrix arrangement or a ladder arrangement, without limitation in the material or the shape of the cold cathode elements or the producing method thereof.

Consequently there can be employed surface conduction electron emitting devices or cold cathode elements of FE type or MIM type.

However, in consideration of the requirement for an inexpensive display apparatus with a large display image size, the surface conduction electron emitting devices are particularly preferred among these cold cathode elements.

More specifically, in the FE type element, since a relative position and shapes of an emitter cone and a gate electrode significantly influence the electron emitting characteristics, there is required an extremely precise manufacturing technology, which is an unfavorable factor for achieving a large image size and a reduction in the production cost.

Also in the MIM type element, it is required to form an insulation layer and an upper electrode with a small and uniform film thickness, which is also an unfavorable factor for achieving a large image size and a reduction in the production cost.

In contrast, the surface conduction electron emitting device is suitable, because of a relatively simple producing method, for achieving a large image size and a reduction in the production cost.

Also the present inventors have found that, among the surface conduction electron emitting devices, a device in which an electron emitting portion or a peripheral area thereof is formed from a fine particulate film is excellent in the electron emitting characteristics and enables an easy manufacture.

Therefore, such device can be considered most suitable for use in multi electron beam sources of an image display apparatus of a high luminance and a large image size.

Therefore the display panel of the aforementioned example employed surface conduction electron emitting devices in which an electron emitting portion or a peripheral area thereof was formed from a fine particulate film.

Methods for producing the multi electron beam sources, the rear plate and the face plate and a method for producing a vacuum container will not be explained further.

Example 2

Figure 4:
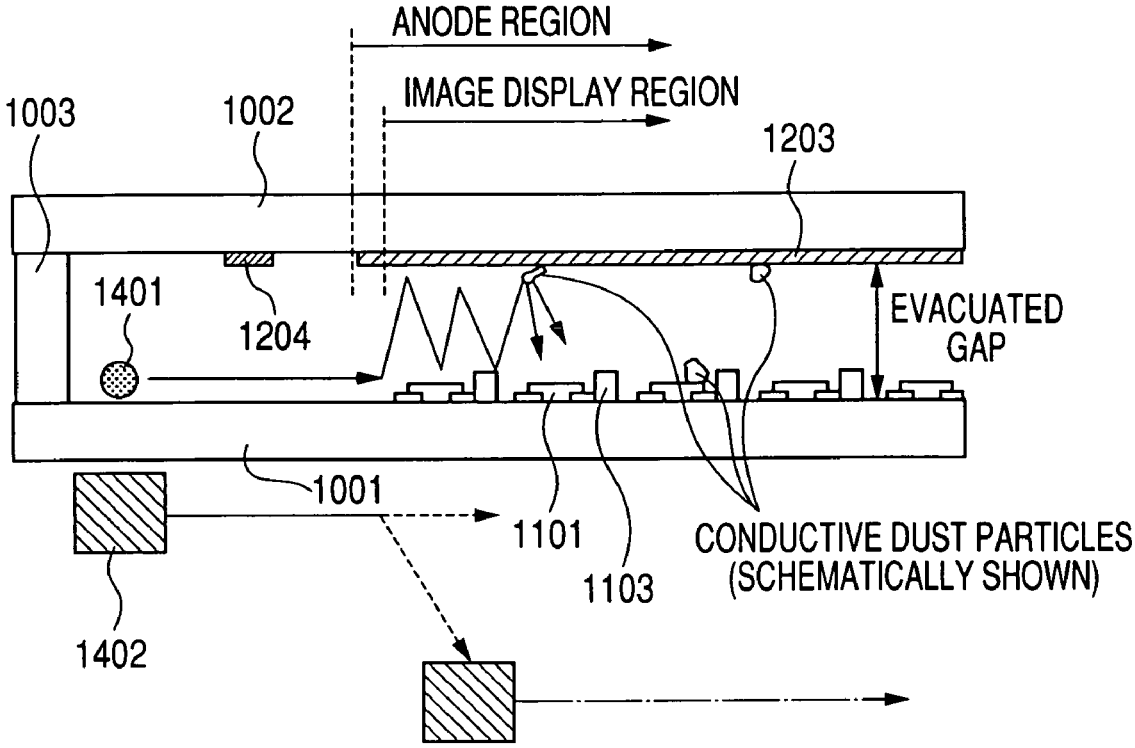
FIG. 4 is a schematic cross-sectional view showing an image display apparatus in a second embodiment of the present invention.

In the following, an example 2 of the present invention will be explained with reference to FIGS. 2, 3 and 4.

However, the image display apparatus employed in the second and subsequent examples is generally same as that in example 1, so that only characteristic portions of the present example will be explained in the following.

In a display panel maintained in vacuum by a rear plate 1001, a lateral wall 1003 and a face plate 1002 as in the example 1, controllable particles 1401 featuring the present invention are present in the vacuum container.

A magnetic force was employed for maintaining and displacing the controllable particles 1401 to the anode region, and magnetic conductive particles were employed as the controllable particles for causing a reciprocating motion by an electric field in the anode region.

The present example employed magnetic conductive-spherical nickel particles as the controllable particles, but this example is not restrictive and any magnetic conductive material may be employed for this purpose.

FIG. 2 is a cross-sectional view showing the rear plate 1001 and the controllable particles 1401 in the present example.

In the present example, an electron emitting device 1101 was constituted of surface conduction electron emitting devices, and was powered by row wirings 1103 and column wirings 1102 which are not illustrated in FIG. 2.

In the present example, a height h of an upper end of the row wirings 1103 from the substrate surface was selected as h=30 μm, and an aperture between the row wirings 1103 was selected at a length a=300 μm.

Also the column wiring 1102, though not illustrated, had a thin film shape (thickness of 1 μm or less) with an aperture of a width of 150 μl.

The column wiring 1102 was prepared with Pt of a thickness of 0.1 μm utilizing a photolithographic process, and the row wiring 1103 was formed with a wiring material containing silver and low-melting glass of a thickness of 30 μm utilizing a screen printing method.

The controllable particles 1401 having a size satisfying the relation 1 do not contact the electron emitting device 1101 as shown in FIG. 2, whereby the electron emitting device can be protected from a damage by the collision of the controllable particles.

The present example employed the controllable particles of a particle radius of 400 μm in consideration of the foregoing.

As in the example 1, the cleaning of the dusts and the minute projections in the anode region of the image display apparatus is conducted after the formation of the vacuum container and before the first application of the high voltage Va (=10 kV) to the anode electrode.

Prior to the cleaning, the controllable particles 1401 are maintained outside the anode region, by a magnetic force of a magnet 1402 provided outside the vacuum container.

At the start of the cleaning, the magnet 1402 is moved toward the anode region as indicated by a solid-lined arrow thereby moving the controllable particles 1401 toward the anode region.

When the controllable particles 1401 are about to enter the anode region, a voltage Vc which induces a reciprocating motion of the controllable particles 1401 but does not induce a discharge is applied to the anode electrode. Vc was selected as 3 kV.

After the controllable particles 1401 are moved to the anode region, the magnet 1402 may be left in its position in case the magnetic force acting on the controllable particles 1401 is smaller than Coulomb force, or may be continued to be moved in the anode region for controlling the displacement of the controllable particles 1401 by the reciprocating motion.

Also in case the magnetic force is strong enough to hinder the reciprocating motion of the controllable particles 1401 by the Coulomb force, the magnet 1402 may be positioned farther to initiate the reciprocating motion of the controllable particles 1401 by the Coulomb force.

Thus the controllable particles 1401 reaching the normal projection region of the anode electrode cause, under a reciprocating motion, the dusts to initiate a reciprocating motion. Also the conductive minute substances (controllable particles and dusts) collide with the minute projections, thereby eliminating the causes of discharge in the normal projection region of the anode electrode.

Thereafter, at the image display, the controllable particles 1401 are moved outside the anode region and retained by the magnet 1402 so as not to move toward the anode region.

For retaining the controllable particles 1401 outside the anode region, the present example utilized a magnetic force, but, as explained in the example 1, a mechanism of more positively holding the controllable particles 1401 after the cleaning may be provided in consideration of a vibration at the transportation or other influences.

Preferably the operation is executed after the formation of the vacuum container and before an initial application of the high voltage Va (=10 kV) to the anode electrode thereby minimizing the unnecessary discharge.

The image display apparatus thus obtained, when subjected to an application of a high voltage of 10 kV, could display a stable image without any discharged over a prolonged period.

Example 3

In the following, an example 2 of the present invention will be explained with reference to FIG. 5.

However, the image display apparatus employed in the present example is generally same as that in example 1, so that only characteristic parts of the present example will be explained in the following.

As in the example 1, in a display panel maintained in vacuum by a rear plate 1001, a lateral wall 1003 and a face plate 1002 as in the example 1, controllable particles 1401 featuring the present invention are present in the vacuum container.

As in the example 2, a magnetic force was employed for maintaining and displacing the controllable particles 1401 to the anode region, and magnetic conductive particles were employed as the controllable particles for causing a reciprocating motion by an electric field in the anode region.

The present example employed magnetic conductive spherical nickel particles as the controllable particles, but this example is not restrictive and any magnetic conductive material may be employed for this purpose.

Figure 5:
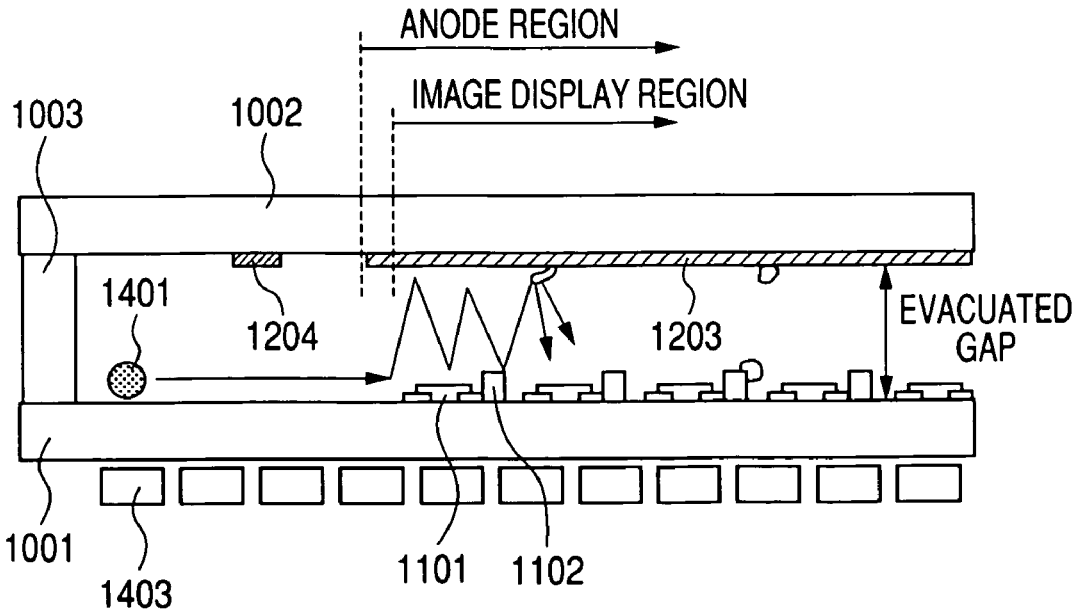
FIG. 5 is a schematic cross-sectional view showing an image display apparatus in a third embodiment of the present invention.
Figure 6A:
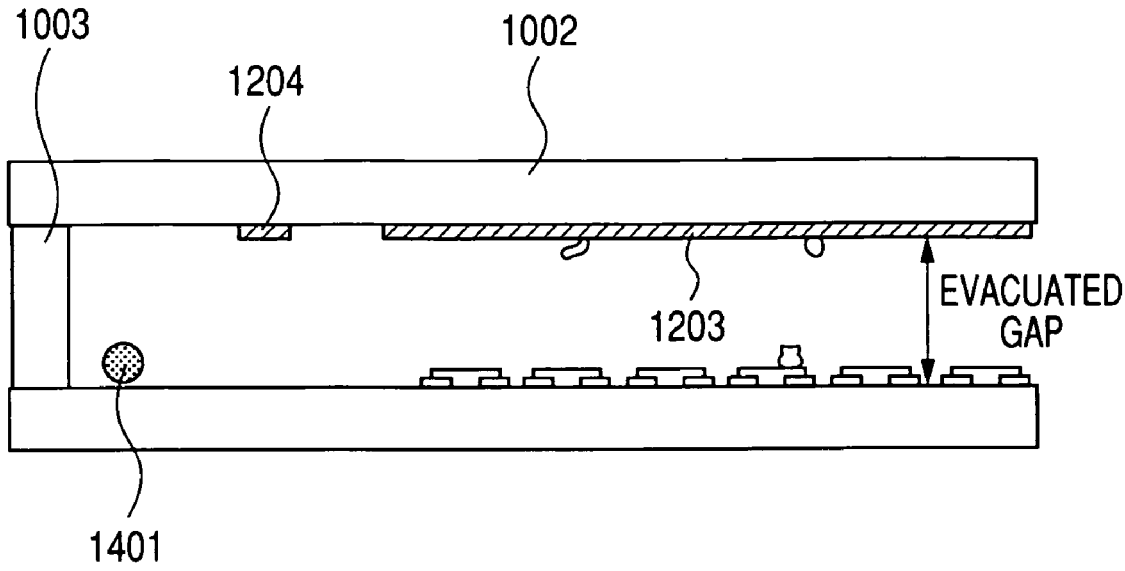
FIGS. 6A and 6B are schematic cross-sectional views showing a cleaning method in an embodiment 1 of the invention.
Figure 6B:
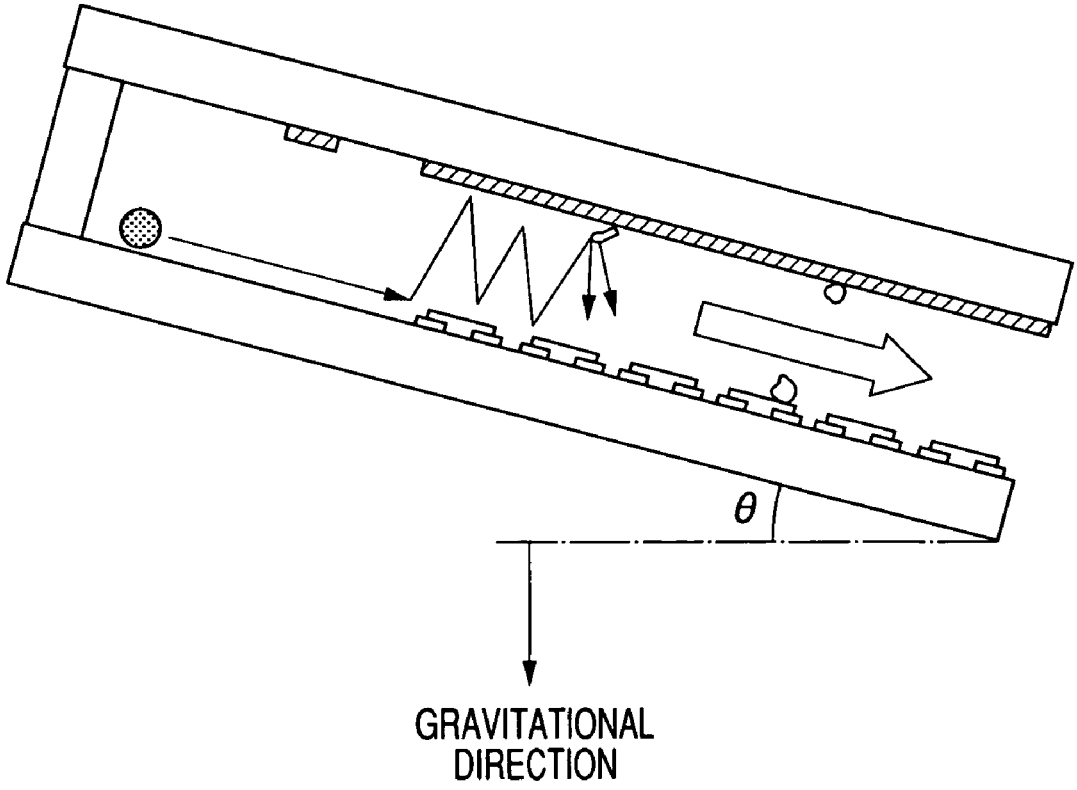

The rear plate 1001 employed in the present example was provided with surface conduction electron emitting devices as the electron emitting devices 1101, which were powered by row wirings and column wirings which are not illustrated in FIG. 5.

In the present example, a height h of an upper end of the row wirings from the substrate surface was selected as h=30 μm, and an aperture between the row wirings was selected at a length a=300 μm.

Also a height of an upper end of the column wirings from the substrate surface was selected as 15 μm, and an aperture between the column wirings was selected as 150 μm.

The column wiring was prepared with a wiring material containing silver and low-melting glass of a thickness of 15 μm utilizing a photolithographic process, and the row wiring was prepared with a wiring material containing silver and low-melting glass of a thickness of 30 μm utilizing a screen printing method.

The controllable particles 1401 having a size satisfying the relation 1 do not contact the electron beam source 1101, whereby the electron emitting device can be protected from a damage by the collision of the controllable particles.

The present example employed the controllable particles of a particle radius of 250 μm in consideration of the foregoing.

As in the example 1, the cleaning of the dusts and the minute projections in the anode region of the image display apparatus is conducted after the formation of the vacuum container and before the first application of the high voltage Va (=10 kV) to the anode electrode.

Prior to the cleaning, the controllable particles 1401 are maintained outside the anode region, by a magnetic force of electromagnets 1403 provided outside the vacuum container.

The electromagnets 1403 are arranged on the rear plate outside the vacuum container, and a magnetic force can be generated at an arbitrary position by energizing an arbitrary electromagnet.

Before the start of the cleaning, the controllable particles 1401 can be moved toward the anode region by energizing the electromagnets 1403 in succession in a scanning mode from an outside to an inside of the anode region.

When the controllable particles 1401 are about to enter the anode region, a voltage Vc which induces a reciprocating motion of the controllable particles 1401 but does not induce a discharge is applied to the anode electrode. Vc was selected as 3 kV.

The electromagnets 1403 may be positioned only outside the anode region for obtaining a desired effect, but may also be positioned inside the anode region and activated from time to time in a scanning mode for controlling the moving direction of the controllable particles 1401 by the reciprocating motion.

Thus the controllable particles 1401 reaching the normal projection region of the anode electrode cause, under a reciprocating motion, the dusts to initiate a reciprocating motion. Also the conductive minute substances (controllable particles and dusts) collide with the minute projections, thereby eliminating the causes of discharge in the normal projection region of the anode electrode.

Thereafter, at the image display, the controllable particles 1401 are moved outside the anode region and retained by the electromagnets 1403 so as not to move toward the anode region.

For retaining the controllable particles 1401 outside the anode region, the present example utilized a magnetic force, but, as explained in the example 1, a mechanism of more positively holding the controllable particles 1401 after the cleaning may be provided in consideration of a vibration at the transportation or other influences.

In case of moving the controllable particles 1401 by the electromagnets 1403 from the exterior of the anode region to the interior thereof as in the present example, such operation is preferably executed after the formation of the vacuum container and before an initial application of the high voltage Va (=10 kV) to the anode electrode thereby minimizing the unnecessary discharge.

Also when the image is not displayed (when Va is not applied), the cleaning with the controllable particles can be executed by applying Vc to the anode electrode and energizing the electromagnets 1402, thereby providing an image display apparatus of a higher reliability.

The image display apparatus thus obtained, when subjected to an application of a high voltage of 10 kV, could display a stable image without any discharged over a prolonged period.

[Effect of the Invention]

The present invention allows, by employing conductive particles (also called controllable particles), to clean the dusts and the minute projections in the vacuum panel of the image display apparatus, thereby providing an image display apparatus of a high reliability which is less prone to cause discharges.

Also the present invention enables to clean a substrate by a reciprocating motion of the conductive particles, thereby obtaining a preferable substrate.

Also in a preferred embodiment of the present invention, in case the substrate has a structure including convex and concave portions, it is possible to clean the structure in the convex portion and to maintain the structure in the concave portion intact.

Also in a preferred embodiment of the invention, as the particles have a higher energy and a larger number of collisions in a convex portion of the opposed conductive member, it is possible to selectively clean a portion on the substrate, corresponding to a normal projection of a convex portion of the conductive member.

Also in a preferred embodiment of the invention, as the particles do not collide with a bottom of a concave portion in case the particles have a size larger than that of the concave portion on the substrate, it is possible to clean the substrate surface while protecting a structure in the bottom of the concave portion.

Also in a preferred embodiment of the invention, in case the particles have a size smaller than a minimum concave portion of the conductive member, the particles can enter the concave portion and giving a contrast in cleaning of the concave portion and the convex portion.

Also in a preferred embodiment of the invention, as a flat-shaped substrate having a conductive surface is opposed to the rear plate, a uniform distance to the rear plate can be realized to achieve a uniform cleaning.

Also in a preferred embodiment of the invention, metal particles are employed as the conductive particles (controllable particles) to enable a cleaning in preferable and inexpensive manner.

Also in a preferred embodiment of the invention, as magnetic particles are employed as the conductive particles (controllable particles), they can be moved or recovered by a magnet to facilitate a movement of the controllable particles to a desired position for example after the cleaning operation.

Also in a preferred embodiment of the invention, there are employed conductive particles (controllable particles) with a particle size of 100 μm or larger, so that the conductive particles (controllable particles) can easily displaced to a desired position after the cleaning operation.

Also in a preferred embodiment of the invention, the conductive particles (controllable particles) have such a size that does not cause a collision with a device present between wirings, so that such device can be protected.

Also in a preferred embodiment of the invention, a cleaning operation can be initiated by moving the conductive particles (controllable particles) to a desired position by gravity.

Also in a preferred embodiment of the invention, by forming the conductive particles with a material similar to that for the wiring, it is possible to reduce contamination and to achieve an appropriate cleaning because of a similar hardness.

Also in a preferred embodiment of the invention, the conductive particles (controllable particles) having a substantially spherical shape provide a constant action area at the collision, thereby achieving a uniform cleaning. In case the conductive particles (controllable particles) are not substantially spherical but have a pointed shape, they may cause an excessive deformation on the substrate surface or may stick to the substrate.

Also in a preferred embodiment of the invention, the conductive particles (controllable particles) have a particle size less than a half of the panel gap to avoid a discharge in the portion of the particle.

Also in a preferred embodiment of the invention, the conductive particles (controllable particles), having a size larger than a gate electrode of a spindt type device, do not collide with the spindt and are therefore applicable to a spindt type FED.

This application claims priority from Japanese Patent Application Nos. 2004-193602 filed on Jun. 30, 2004 and 2005-169454 filed on Jun. 9, 2005, which are hereby incorporated by reference herein.

What is claimed is:

1. A producing method for an image display apparatus including a first substrate with an conductive surface, and a second substrate with an conductive surface opposed to the first substrate, the method comprising:

a step of applying a voltage between the first substrate and the second substrate; and a step of introducing conductive particles into a space between the first substrate and the second substrate under the voltage application;

wherein the voltage applied between the first substrate and the second substrate causes the introduced conductive particles to reciprocate between the first substrate and the second substrate and to collide with dust attached to the first or second substrate, thereby removing the dusts from the first or second substrate.

2. A producing method according to claim 1, wherein the first or second substrate have convex and concave portions and the method selectively remove the dusts from the convex portion.

3. A producing method according to claim 2, wherein the conductive particles have a minimum size larger than a maximum size of the concave portions of the substrate.

4. A producing method according to claim 1, wherein the conductive particles are metal particles.

5. A producing method according to claim 1, wherein the conductive particles are formed by a magnetic material.

6. A producing method according to claim 1, wherein the conductive particles have a minimum size equal to or larger than 100 μm.

7. A producing method according to claim 1, wherein the first substrate has plural stripe-shaped electric wirings in which a spacing a of adjacent electric wirings, a height h thereof and a minimum size r of the conductive particles satisfy a relation:

$$r - \sqrt{r^2 - \left(\frac{a}{2}\right)^2} < h$$

8. A producing method according to claim 7, wherein the conductive particles have a composition same as that of the wiring.

9. A producing method according to claim 5, wherein the conductive particles are moved by a magnetic force.

10. A producing method according to claim 1, wherein the conductive particles have a substantially spherical shape.

11. A producing method according to claim 1, wherein the conductive particles have a maximum size less than a half of a distance between the first substrate and the second substrate.

12. An image display apparatus including an container comprising:

a rear plate having an electron beam source; and a face plate having a phosphor which emits a light by an electron beam irradiation and an anode electrode for applying an electron accelerating voltage;

wherein the image display apparatus further comprises, in the container, conductive particles, a mechanism for maintaining the conductive particles within the container but outside a normal projection region from the anode electrode onto the rear plate, a mechanism for moving the conductive particles into the normal projection region, and a mechanism for causing the conductive particles to execute a reciprocating motion within the normal projection region.

13. A producing method for a substrate having a conductor on a surface thereof, the method comprising:

a step of placing a conductive member in an opposed relationship, across a space, to the conductor-including surface of the substrate and applying a voltage between the conductor and the conductive member; and a step of introducing conductive particles into the space between the conductor and the conductive member under the voltage application;

wherein the voltage applied between the conductor and the conductive member causes the introduced conductive particles to execute a reciprocating motion between the substrate and the conductive member and to collide with dust attached to the substrate, thereby removing the dust from the substrate.

14. A cleaning apparatus comprising:

means which positions a substrate having a conductor on a surface thereof;

means which places a conductive member in an opposed relationship, across a space, to the conductor-including surface of the substrate;

means which provides the conductor with a first potential and the conductive member with a second potential different from the first potential, thereby generating an electric field between the conductor and the conductive member;

means which introduces conductive particles between the conductor and the conductive member with thus provided potentials; and means which causes the introduced conductive particles to execute a reciprocating motion between the substrate and the conductive member.

* * * * *